United States Patent [19]

Nicklaus et al.

[11] 4,062,162

[45] Dec. 13, 1977

[54] CLIP FOR JOINING AND MAINTAINING ALIGNMENT OF ACOUSTICAL TILE IN A STARTING ROW THEREOF

[75] Inventors: David F. Nicklaus, Mountville; James C. Ollinger, Lancaster, both of Pa.; Thomas M. Petrie, Carrollton, Tex.

[73] Assignee: Armstrong Cork Company, Lancaster, Pa.

[21] Appl. No.: 758,003

[22] Filed: Jan. 10, 1977

[51] Int. Cl.[2] ..... E04B 5/52; E04B 1/38

[52] U.S. Cl. ..... 52/481; 52/489; 52/582; 52/714; 85/13

[58] Field of Search ..... 52/582, 492, 284, 496, 52/354, 714, 715, 668, 747, 479, 481, 483–489; 85/13

[56] References Cited

U.S. PATENT DOCUMENTS

| | | | |
|---|---|---|---|
| 1,080,002 | 12/1913 | Dare | 52/714 |
| 1,470,251 | 10/1923 | Ahlvin | 85/13 |
| 3,143,030 | 8/1964 | Muller | 85/13 |

FOREIGN PATENT DOCUMENTS

| | | | |
|---|---|---|---|
| 193,405 | 12/1937 | Switzerland | 85/13 |

*Primary Examiner*—J. Karl Bell

[57] ABSTRACT

A metal clip for joining the tiles in a starting row of a suspended ceiling system with their edges which are farthest from the wall in aligned relationship and stabilizing them against possible subsequent misalignment is described. The clip comprises a body member having two planar, longitudinally extending side portions. An intermediate portion joining the side portions has a central portion which is elevated above the plane of the sides. Downwardly projecting prongs are provided adjacent one end of the clip on each side thereof. The opposite end of the clip has no prongs. The clip is installed to overlie the opposing back edges of a pair of adjacent edge-aligned tile, with the end of the clip which has no prongs being in contact with a wall-mounted support member for the tile, and the prongs adjacent the opposite end of the clip being embedded in the back surfaces of the tiles adjacent their edge portions. The tiles are thus joined and stabilized against misalignment.

3 Claims, 3 Drawing Figures

24
23
24
8
4
13
2
9
3
5
6
30
11
1
22
10
6
15
7
19
14
12
16
29
28
21

CLIP FOR JOINING AND MAINTAINING ALIGNMENT OF ACOUSTICAL TILE IN A STARTING ROW THEREOF

CROSS-REFERENCE TO RELATED APPLICATIONS

Copending U.S. patent application Ser. No. 758,004 filed Jan. 10, 1977 by James C. Ollinger relates to a refinement of this invention whereby a shorter, easier-to-install and safer clip is obtained.

BACKGROUND OF THE INVENTION

1. Field of the Invention

This invention relates to a metal clip for use in installing the starting row of tiles in a suspended acoustical ceiling system. More particularly, the invention relates to an elongated metal clip having horizontal, longitudinally extending side portions joined by an intermediate portion, the central portion of which is elevated above the plane of the sides. Downwardly projecting prongs are provided adjacent one end of the clip. The other end of the clip is devoid of prongs. In use, the clip is positioned over the opposing back edges of two adjacent edge-aligned tiles, with the end of the clip having no prongs being in contact with the support member on the wall. The prongs adjacent the opposite end of the clip are then pressed into the tiles to join and further stabilize them against misalignment.

2. Description of the Prior Art

It is known to provide concealed ceiling suspension systems wherein the supporting members for the acoustical tile are not visible when viewed from below. Such a system is described in U.S. Pat. No. 3,736,012, wherein the main runner system of the ceiling suspension system is fastened by wires to the overlying ceiling structure of the building. The main runner structures extend all parallel to each other and are appropriately spaced apart. Extending perpendicular to the main runner structure there is provided a series of cross members upon which the actual ceiling panels or tile are supported. The support flanges for the cross members fit in kerf structures in the ceiling panels or tiles and support them in position in the ceiling region. For simplicity of construction, the vertical web of the cross member is provided with a substantially T-shaped groove into which may be slid the structure of the main runner. Thus, the main runner is able to carry the cross member, and the cross member may be adjusted to any desired location along the main runner.

U.S. Pat. No. 3,143,030 relates to a generally U-shaped connector having toothed or serrated edge portions which protrude downwardly on each side with alternate teeth forming an acute angle with each other. The connector is adapted to be placed lengthwise across the opposed edges of two adjacent work pieces and hammered to cause the teeth to penetrate the work piece and bend out of their original plane, thus anchoring the connector in the material.

Another connector for securing together adjacent wood structural members is disclosed in U.S. Pat. No. 3,841,194 and comprises a metal plate having a plurality of elongated integral teeth which are struck outwardly from the plate and extend generally perpendicularly thereto.

U.S. Pat. No. 2,108,831 relates to a fastener for securing the adjacent ends of wood sections together. The fastener is formed from a piece of sheet metal and has a body portion with prongs extending downwardly from one half thereof at oblique angles with respect to the body portion and prongs at the other half of the body portion extending at oblique angles in a direction opposite to that of the prongs on the other half of the body.

The clips of the prior art do not fulfill the need for a clip which may be installed on the back portions of in-place, edge-aligned acoustical tile of the starter row in a ceiling system and which function to join the tile and stabilize them against possible subsequent misalignment by extending along the tiles adjacent edges into contact with a wall-mounted support for the tile.

SUMMARY OF THE INVENTION

This invention relates to a metal clip for joining acoustical tiles in the starting row of a suspended acoustical ceiling structure and holding them with the edges thereof which are farthest from the wall in aligned relationship with each other by joining adjacent tiles at their opposed edge portions and extending therealong into contact with a support structure therefor.

The clip is formed from a single piece of sheet metal and includes a body member having planar, longitudinally-extending side portions. Substantially triangularly-shaped integral prongs are struck from the side portions and extend downwardly therefrom in a plurality of planes parallel to each other and perpendicular to the plane of the sides. The body of the clip includes a raised intermediate portion connecting the side portions. The clip is adapted to be positioned over opposing back edges of in-place, edge-aligned tile in the starting row of a suspended ceiling system. The clip is so positioned with the end opposite the one with the prongs on, in contact with a wall-mounted support member for the tiles. Pressure is then applied to the end of the clip having the prongs on to embed them in the surfaces of the tiles adjacent their edge portions. The tile is thus joined and stabilized against misalignment, especially by movement of the tile in the direction of the wall, in an easy, convenient, and effective manner.

DESCRIPTION OF THE PREFERRED EMBODIMENT

Figure 1:
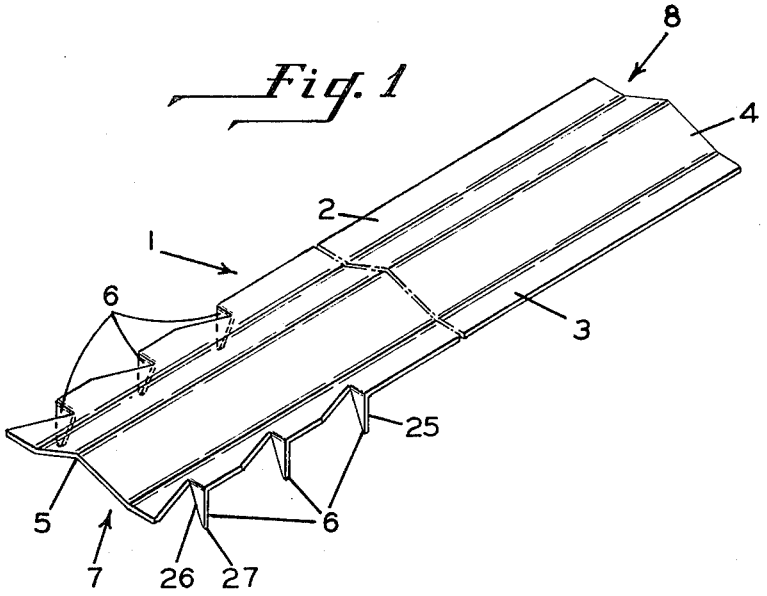
FIG. 1 is a broken isometric view showing the clip of this invention.

Referring to the drawings, there is shown in FIG. 1 a clip 1, which is preferably formed from a single, rectangularly-shaped piece of sheet metal. As shown, the clip 1 has two planar, longitudinally-extending side portions 2 and 3. An intermediate portion 4 of the clip 1 joins the side portions 2 and 3 and has a central portion 5 which is elevated above the plane of the sides 2 and 3 to aid in rigidifying the clip. Downwardly projecting prongs 6 are formed on side portions 2 and 3 adjacent the end 7 of clip 1 and are adapted to be embedded, as shown more clearly in FIG. 3, in the back surfaces of the tiles 9 and 10 adjacent their opposing edge portions 11 and 12. Prongs 6 are struck downwardly from side portions 2 and 3 in a known manner and, as shown in FIG. 1, extend from sides 2 and 3 in vertical planes perpendicular thereto. The prongs 6 on side 2 may be tranversely aligned with the prongs on side 3. Preferably, as shown (see FIGS. 1 and 3), the prongs 6 are substantially triangular in shape with the outer edges thereof being substantially perpendicular to the sides 2 and 3 and the inner edges 26 extending inwardly and upwardly at an angle from the tips 27 of the prongs 6. By so shaping the prongs, they tend to draw the adjacent tiles together when they are forced thereinto. The opposite end 8 of clip 1 is devoid of prongs because, in use, many times it is desirable to decrease the overall length of the clip 1, depending on the dimensions of the tiles upon which the clip is being used. The primary function of the end 8 of the clip 1, as shown in FIGS. 2 and 3, is to butt against the vertical portion 13 of a wall-mounted, substantially L-shaped wall molding member 14 to act in combination with the prongs 6 to prevent any tiles which may not be flush against the portion 13 of the wall molding member 14 from being accidantially moved in that direction when installing additional tile after the edges 15 and 16 have been aligned with each other and clip 1 installed thereon.

Figure 2:
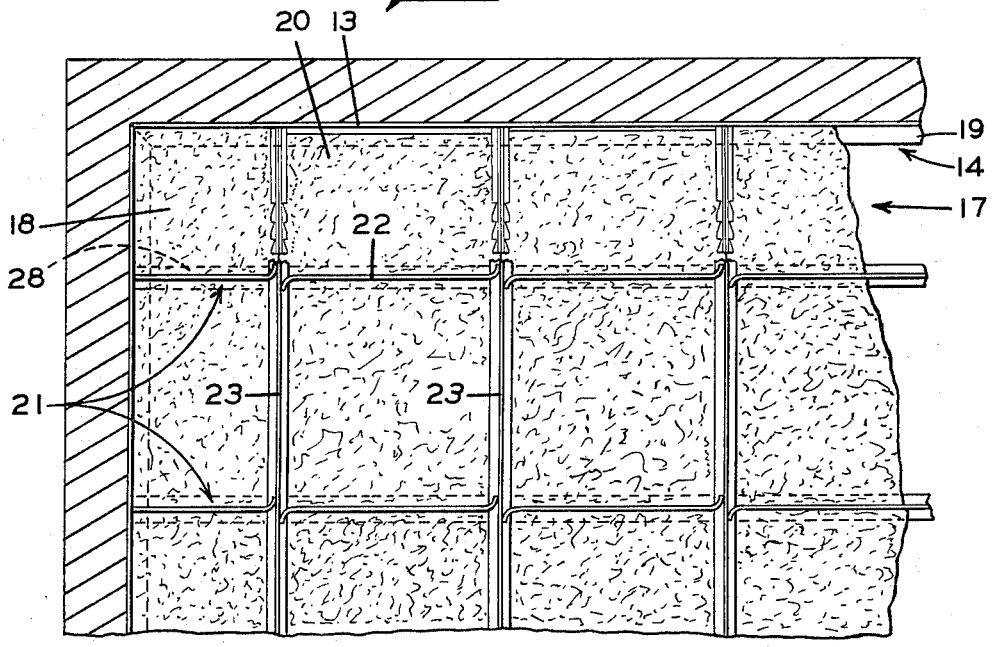
FIG. 2 is a plan view looking down on the back of a portion of an assembled ceiling structure, and showing the clip of this invention as it is used in the installation of the first row of tile therein.

In FIG. 2 of the drawings, there is shown a plan view, looking down on the back of a portion of an acoustical ceiling wherein the tiles are in their installed positions, and the clips 1 of this invention are installed in the starting row 17 in the location where they would be placed to join the tile and stabilize them against misalignment during installation of subsequently installed tiles. The following description will be more readily understood by the simultaneous reference to FIGS. 2 and 3 of the drawings. It will be understood that the clip of this invention may be used in connection with tiles having edge configurations other than the one shown and described herein, which are used merely as one non-limiting example.

Figure 3:
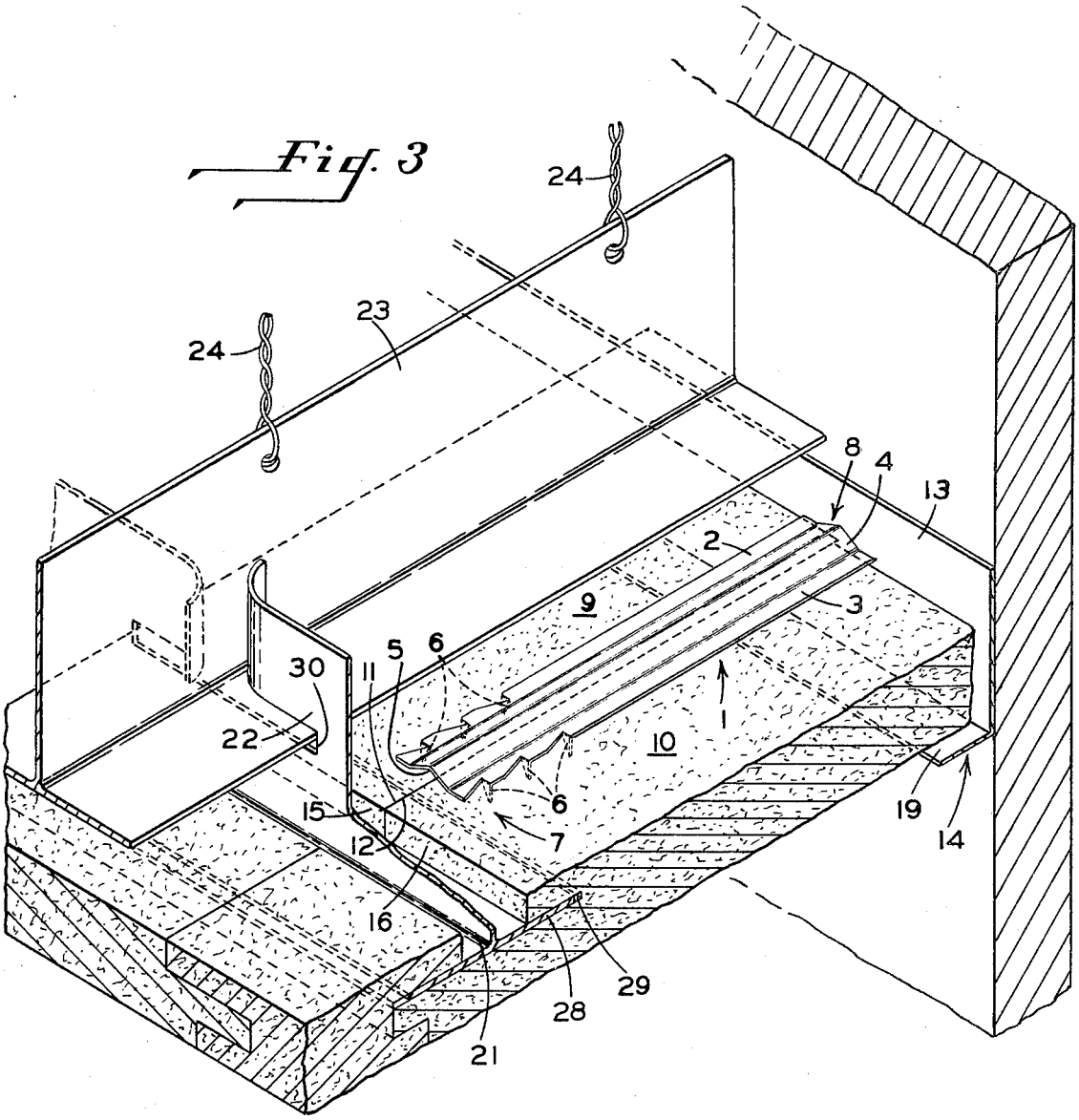
FIG. 3 is an enlarged isometric view of a portion of a suspended ceiling structure, partially broken away and partially in section, and showing one of the clips of this invention installed on a couple of tiles in the first row thereof.

As indicated in FIG. 3 of the drawings, one type of suspended ceiling with which the clip of this invention may be used includes main runner structures 23, which may be suspended by support means such as wires 24 from an overlying ceiling structure of a building (not shown). The main runner structures 23 extend all parallel to each other at an appropriate spacing apart. Extending perpendicular to the main runner structure there is normally provided a series of cross members 21 upon which the actual ceiling panels or tile are supported. The support flanges 28 on the cross members 21 fit into kerf structures 29 in the ceiling panels or tile and support them in position in the ceiling region. For simplicity of construction, the vertical web 22 of the cross member 21 is provided with a T-shaped groove 30 into which may be slid the structure of a main runner 23. Thus, the main runner 23 is able to carry the cross member 21, and the cross member 21 may be adjusted to any location along the main runner 23. A structure of this type is shown and described in U.S. Pat. No. 3,736,012 and, as noted therein, the structure is extremely simple to put together, does not require any complicated tooling or adjusting of the runner structure to fasten it together.

As previously noted, the clip of this invention is used in connection with the starting row 17 of tile in a ceiling system such as shown in FIGS. 2 and 3 of the drawings. As shown therein, one edge of the starting row 17 of tile is supported adjacent a wall of the room by means of a substantially L-shaped wall molding member 14 which is normally attached around the perimeter of the wall at the appropriate location by known means. Because most rooms vary in size and because most acoustical tile are manufactured in units of the same size, normally the border tiles, which include those in the starting row 17, must be cut to the proper dimensions to fill the space between the wall and the first and last rows of full-sized tile. Another reason the tile must be cut is because of the fact that very few walls are perfectly straight and frequently bow either in or out. Further, most walls will be slightly crooked since wall studs are seldom exactly straight in line with one another. Therefore, all tiles in the first row 17 must be cut to match the contours of the starting wall as closely as possible; however, it has been found that, due to almost inevitable inaccuracies in such cutting, there still remained a need for a simple means by which the tile in the starting row could be joined together with their edges which are farthest from the wall in aligned relationship and stabilized against misalignment during the installation of subsequently installed tiles. This is the purpose served by the clip of this invention.

In installing the starting row of tiles 17 in the ceiling system, the first tile 18, after having been cut to the appropriate size, is installed in the corner of the room, as shown in FIG. 2, with the wall-adjacent edges of the tile resting on the horizontal portion 19 of wall molding member 14. A second tile 20 which, of course, will have an edge configuration which will mate with the edge configuration of the first tile 18, is then placed in position as shown in FIG. 2. As shown in FIG. 3, opposing edge portions 11 and 12 of the tile are then in contact with each other. The edges 15 and 16 of the tile (FIG. 3) are then aligned and clip 1 is placed in position, as shown in FIGS. 2 and 3, over, and extending along the tile joint formed by abutting edge portions 11 and 12 thereof with the end 8 of clip 1 in contact with the vertical portion 13 of wall molding member 14. Pressure is then exerted on the end 7 of clip 1 to embed the prongs 6 in the back surface portions of adjacent tiles, such as 9 and 10 (FIG. 3). A cross member 21, previously installed on the main runners 23, is then slid along the runner and the flange 28 is slid into the kerfs (slots) 29 in the tiles 9 and 10. This procedure is repeated using additional cross members which lock together until the last tile in the row is installed. The process is then repeated for installing the second row of tiles except that the clips are not used.

Thus, it can be seen that the clip of this invention provides a simple and effective concealed means of joining the tile in a starting row of a suspended ceiling system in perfect edge alignment and, additionally, it provides a sure means for stabilizing the tile against possible misalignment when installing subsequent tiles.

What is claimed is:

1. An edge-aligned, joined and stabilized starting row of tiles in a suspended ceiling system, comprising in combination a plurality of ceiling tiles, means mounted on a wall for supporting the tiles at their edge portions which are adjacent the wall, means for supporting the edges of said tiles which are opposite those adjacent the wall, and clip means joining said tiles to each other, said clip means each comprising a body member having planar, longitudinally extending side portions, said clip being mounted on said tiles to overlie back surface portions thereof adjacent opposing edges of adjacent tiles and extend therealong into contact with the wall-mounted support therefor, prong means on said body member adjacent the end thereof which is opposite the end in contact with the wall-mounted support member, said prong means extending downwardly from the side portions of said body member in planes substantially perpendicular to the plane of the sides and penetrating the surface portions of the tiles.

2. The edge-aligned, joined and stabilized starting row of tiles in a suspended ceiling system according to claim 1, wherein the body member includes an intermediate portion which joins the side portions and which has a central portion which is elevated above the plane of the sides, and wherein said prong means comprise a plurality of substantially triangularly-shaped pieces of said side portion of the body member which have been struck downwardly therefrom, have substantially flat surfaces which lie in a plurality of parallel planes, and wherein the prong means on each side are in longitudinal alignment with each other and are substantially equally spaced apart.

3. A metal clip for joining acoustical tiles and contacting a support structure therefor to hold the tiles in the starting row of a suspended acoustical ceiling structure in edge-aligned relationship with each other, said clip comprising:

a. a body member having planar, longitudinally-extending side portions which lie in a single plane, said body member including an intermediate portion which joins the side portions of the body and has a central portion which is elevated above the plane thereof, said intermediate portion including side portions which extend downwardly from the central portion thereof in planes which are at an angle to each other and to the plane of the sides, said body member being adapted to overlie the back surface portions of adjacent tiles adjacent their opposing edges and extend lengthwise therealong into abutting relationship with a support member for said tiles; and b. prong means on each side portion of said body adjacent one end only thereof, the opposite end being devoid of prongs, said prong means comprising substantially triangularly-shaped portions of the longitudinally-extending side portions of said body which have been struck downwardly therefrom and have flat surfaces which lie in a plurality of planes parallel to each other and substantially perpendicular to the plane of the sides, the prongs on each side being in longitudinal alignment with each other and substantially equally spaced apart, said prong means being adapted to penetrate the back surface portions of adjacent tiles adjacent their opposing edges at a point remote from a tile support member when the end of said body which is devoid of prongs is in abutting relationship with said tile support member, thereby securing the tiles against movement relative to each other and to the support member.

* * * * *